US007504930B2

(12) United States Patent
Beyda et al.

(10) Patent No.: US 7,504,930 B2
(45) Date of Patent: Mar. 17, 2009

(54) ALARM CLOCK SYNCHRONIZED WITH AN ELECTRIC COFFEEMAKER

(76) Inventors: Joseph William Beyda, 21580 Edward Way, Cupertino, CA (US) 95014; Rachel Ann Beyda, 21580 Edward Way, Cupertino, CA (US) 95014

( * ) Notice: Subject to any disclaimer, the term of this patent is extended or adjusted under 35 U.S.C. 154(b) by 347 days.

(21) Appl. No.: 11/640,155

(22) Filed: Dec. 15, 2006

(65) Prior Publication Data

US 2008/0143578 A1 Jun. 19, 2008

(51) Int. Cl.
*G08B 1/00* (2006.01)

(52) U.S. Cl. ..... 340/309.8; 340/309.16; 368/1; 368/10

(58) Field of Classification Search ..... 340/309.8, 340/309.16, 309.3, 309.9, 566; 367/197–199; 368/1, 10; 99/280
See application file for complete search history.

(56) References Cited

U.S. PATENT DOCUMENTS 4,262,585 A * 4/1981 Leuschner et al. ..... 99/280
4,330,702 A * 5/1982 Cheng ..... 219/492
4,566,802 A * 1/1986 Koehler ..... 368/9
4,833,978 A * 5/1989 Martone et al. ..... 99/280
D339,952 S * 10/1993 Rosen ..... D7/305
5,694,115 A * 12/1997 Desatoff ..... 340/679
5,895,595 A * 4/1999 Haden ..... 219/432
6,021,324 A * 2/2000 Sizer et al. ..... 340/679
6,587,739 B1 * 7/2003 Abrams et al. ..... 340/310.11
6,931,984 B2 * 8/2005 Lassota ..... 99/280
7,228,190 B2 * 6/2007 Dowling et al. ..... 700/94
2006/0222736 A1 * 10/2006 Keller ..... 426/45
2007/0288251 A1 * 12/2007 Ebrom et al. ..... 705/1

* cited by examiner

*Primary Examiner*—John A Tweel, Jr.
(74) *Attorney, Agent, or Firm*—The Mueller Law Office, P.C.

(57) ABSTRACT

A system, including an alarm which is synchronized with a coffeemaker, is used to coordinate wake-up time with coffee brewing time. In one embodiment of the invention, the alarm includes an alarm timer, an alarm controller, alarm input (e.g., dial or button), a speaker, circuitry for sound generation and a display. A user sets the alarm timer, and the speaker is capable of providing a sound to wake the user at the set time. The circuitry for sound generation is capable of generating a tone and transmitting the tone with the same speaker. This tone is transmitted to an electric coffeemaker which includes, a tone receptor (e.g., microphone and amplifier), and coffee brewing circuitry. The tone receptor receives the tone generated by the alarm and forwards related data to the coffee brewing circuitry. The coffee brew cycle is activated in response. The alarm may be an alarm clock radio and the speaker may transmit an ultrasonic or audible tone. Moreover, activation of the brew cycle may be programmed to occur at a specific time before or after the wake-up time.

18 Claims, 6 Drawing Sheets

Alarm Clock Radio 100

Alarm Clock Radio 100

Automatic Coffeemaker 200

Entire Brewing System 300

ALARM CLOCK SYNCHRONIZED WITH AN ELECTRIC COFFEEMAKER

BACKGROUND OF THE INVENTION

It is generally appreciated that there are many known technologies for providing coffeemakers and alarm clocks. Modern electric drip coffeemakers are commonplace in the domestic appliance market. These coffeemakers offer numerous options. For example, some will even grind beans automatically, and then brew the coffee. Some continue to heat the coffee after it is brewed, and some dispense the coffee into an insulated container for warmth. Most of these coffeemakers begin their operation in response to the pressing of a brew button, which starts the cycle of heating the water in a reservoir, such that the hot water drips through ground coffee into an awaiting receptacle. This brew button may be called by other names, such as "start", "on", or other names with the same general meaning. For simplicity, it will be referred to as the "brew" button. The ground coffee may be placed in the machine before the brew cycle. In machines that grind beans, coffee beans may be placed in the grinding receptacle instead, and the pressing of the brew button causes the beans to first grind, followed by the dispensing of the hot water through the now ground beans. In addition, the water can be placed in the reservoir before the cycle begins, either by a user pouring it there, or through a directly plumbed connection to the household water supply, depending on the model of coffeemaker.

Some of these coffeemakers have a clock and timer built-in, so you can preset the brew start time in advance. In these cases, the user first determines how to program the coffeemaker. Typically the user begins by setting the desired time at which brewing should start. The user typically would press a "timer" or similarly named button. This causes the brew cycle to start at a time the user has already set using time-setting techniques on electronic timers, clocks, and similar devices as set forth in user manuals. This time presetting is typically done by first pressing a button to enter the preset time programming mode, and then pressing the same or other buttons to move forwards or backwards to the desired clock time for starting the brewing. Finally, there is usually another button press to confirm this is the desired time, or after a period of not touching any buttons, the current displayed time is set as the desired time. There are some analog clock timers also in use, where knobs and dials are used to set the start time. The disadvantage of any of these methods for presetting the brew start time is that the user who wants to wake to fresh coffee must set the brew time on their coffee pot for the correct time. The user must similarly set their bedside alarm clock to wake them at an appropriate time. The user must set both of these timers, and if their desired wake time changes because of unforeseen circumstances (e.g., a child wakes in the night) or foreseen circumstances (e.g., switching times between weekends and weekdays), the user must reset both their alarm clock and their coffeemaker to the new time.

Some designers have tried to get around this problem by creating complex home automation systems, where a central controller or computer synchronizes the activities of many appliances in the house. A user could set a program in such a controller that triggers an alarm at their bedside, and starts the coffeemaker in the kitchen accordingly. The problem with this system is it requires a separate centralized controller along with the interconnection to all of the appliances. Also, home automation systems are not inexpensive, and they are often difficult to operate. What is needed is an inexpensive and simple way to automatically coordinate wake-up time with coffee brew time.

SUMMARY OF THE INVENTION

A system, including an alarm which is synchronized with a coffeemaker, is used to coordinate wake-up time with coffee brewing time. In one embodiment of the invention, the alarm includes an alarm timer, an alarm controller, alarm input (e.g., dial or button), a speaker, circuitry for sound generation and a display.

A user sets the alarm timer, and the speaker is capable of providing a sound to wake the user at the set time. The circuitry for sound generation is capable of generating a tone and transmitting the tone with the same speaker. This tone is transmitted to an electric coffeemaker which includes, a tone receptor (e.g., microphone and amplifier), and coffee brewing circuitry. The tone receptor receives the tone generated by the alarm and forwards related data to the coffee brewing circuitry. The coffee brew cycle is activated in response.

DETAILED DESCRIPTION OF THE INVENTION

Reference now will be made in detail to embodiments of the disclosed invention, one or more examples of which are illustrated in the accompanying drawings. Each example is provided by way of explanation of the present technology, not limitation of the present technology. In fact, it will be apparent to those skilled in the art that modifications and variations can be made in the present technology without departing from the spirit and scope thereof. For instance, features illustrated or described as part of one embodiment may be used on another embodiment to yield a still further embodiment. Thus, it is intended that the present subject matter covers such modifications and variations as come within the scope of the appended claims and their equivalents.

An alarm clock is a common awakening device found in modern households. An alarm clock radio includes a speaker that could be used to generate an ultrasonic signal. While a clock radio is used as the basis for this description, it is understood that other alarm clock devices could be modified at additional cost to offer the speaker capability that is utilized in the current invention.

Since the alarm clock radio found in most homes already contains a speaker and circuitry for generating sound, and already contains a timer and a controller, we propose adding an additional sound to the alarm sound, preferably in the ultrasonic range. Outside of the range of human hearing, it would be a given frequency that the coffeemaker would receive and recognize. The cost of the alarm clock radio would not vary significantly, as all the electronics and timers are already present. There would be no need for a central automation system in the house for this simple coordination between the alarm clock and the electric coffeemaker. All that would be needed is a small ultrasonic receiver (e.g. microphone and basic ultrasonic tone detector circuitry) in the coffeemaker that could receive this signal and begin the brew cycle. Optionally, a delay timer could be set in the coffeemaker to wait a certain number of minutes after receipt of such signal before starting the drip signal if the user prefers the coffee be ready later. Optionally, a timer could be set in the alarm clock that causes the ultrasonic signal to be sent a certain number of minutes in advance of or after the audible alarm to allow the coffee to start brewing before or after the user is awakened, if the user prefers it to be ready at a particular time. All of these functions are thus achieved without significant increase in cost to either the alarm clock radio or the coffeemaker, thereby providing a large advantage over the use of a home automation system with a central controller to accomplish the synchronized waking of the user with automatic coffee brewing.

Figure 1:
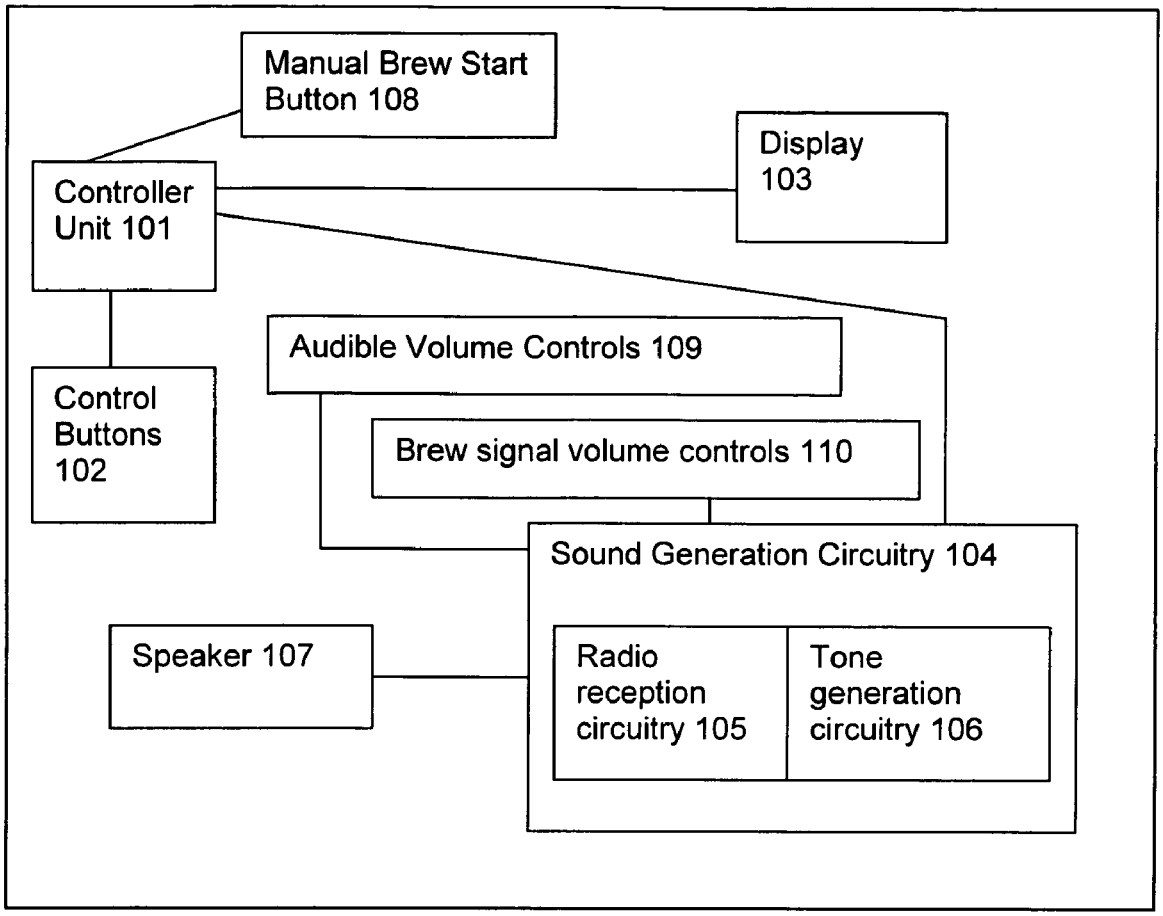
FIG. 1 contains a block diagram representing the parts of an alarm clock.

Now turning to FIG. 1, an alarm clock block diagram is provided. The alarm clock radio 100 includes a controller unit 101 which performs the timing functions and process user input from control buttons 102 as well as sending output to the display 103 and the sound generation circuitry 104. This sound generation circuitry 104 contains radio reception circuitry 105 and tone generation circuitry 106. The sound generation circuitry 104 sends its output to speaker 107. All these radio components 101, 102, 103, 104, 105, 106, 107 and 109 are those typically available in commercially available clock radios.

In the typical operation of a clock radio, the user programs the clock radio before going to sleep using control buttons 102, while viewing the wake time and other options on display 103. Once the alarm is set, at the preprogrammed time, controller unit 101 turns on sound generation circuitry 104. Whether radio reception circuitry 105 and tone generation circuitry 106 both come on, or just one of the two come on, depends on the options previously programmed by the user using control buttons 102 and controller unit 101. The user typically shuts off the alarm by pushing on control buttons 102. The various button functions and programming methods described are those typically found in commercially available alarm clock radios.

With a typical clock radio, sounds coming from the sound generation circuitry through the speaker 107 wake up the user at a time previously set by the user. The user will have previously set if they want to be woken only to radio sounds, in which case only the sounds from the radio reception circuitry 105 are used. Alternatively, the user may have previously set to wake only to tones, in which case only sounds from the tone generation circuitry 106 are used. Alternatively, the user may have previously set to wake to radio sounds and tones, in which case the signals from radio reception circuitry 105 and are combined inside sound generation circuitry 104. All of these wake methods are those typically found in commercially available clock radios. Whichever method the user has chosen to wake up to, in addition to user awakening sounds coming from sound generation circuitry 104, the tone generation circuitry 106 inside sound generation circuitry 104 also sends the brew start signal to speaker 107. This brew start signal is a tone, preferably in the ultrasonic range, but if necessary, can be an audible tone, that is sent to the speaker 107 along with the awakening sounds. To alleviate possible interference from the awakening sounds, when the user shuts off the alarm using user control buttons 102, the brew start signal tone optionally can continue to be sent for an additional number of seconds, for example five seconds, to ensure it is detected by the coffeemaker 200.

During the programming phase of the clock radio, the user might have the option to trigger the sending of the brew start signal from the tone generation circuitry 106 a certain number of minutes ahead or after the awakening signals produced by sound generation circuitry 104, to facilitate the coffee being ready at a time that best suits the user's desired morning routine.

Optional user button 108 is the brew start button, and it can be located on the clock radio to allow manual starting of the brew cycle. Pressing this button causes the brew start signal tone to be sent immediately, for a certain number of seconds, for example 10 seconds. This can be useful if a user wakes up before the alarm time or for testing the system. For installation testing the user could press the user button 108 and see if the coffeemaker commences. Also, the clock radio is equipped with audible volume controls 109 that set the volume of the awakening sounds. Optionally, another set of volume controls, brew signal volume controls 110, could be used to set the volume of the brew signal, so that if the brew signal is not detected during the testing of the system, the user could raise the volume and try again. Volume controls are of the type typically found in commercially available clock radios and they are shown as connecting to the sound generation circuitry 104, but they can also be connected to the controller unit 101.

While it is assumed that the speaker and radio circuitry is capable of producing an ultrasonic signal, if this is outside the capabilities of the alarm clock radio and its circuitry, an audible tone could be used. In any case, tone generation, either ultrasonic or audible, is a known technique. The tone can be sent in parallel with the audible alarm signal that awakens the user, or can be sent in advance, or at a later time, depending on the user's programming of the clock radio device. Optionally, the manual brew start button 108 could be in place on the clock radio, so the user could first awaken, and start the brew cycle remotely from the clock radio by pressing the manual brew start button 108 to send the ultrasonic or audible signal.

Figure 2:
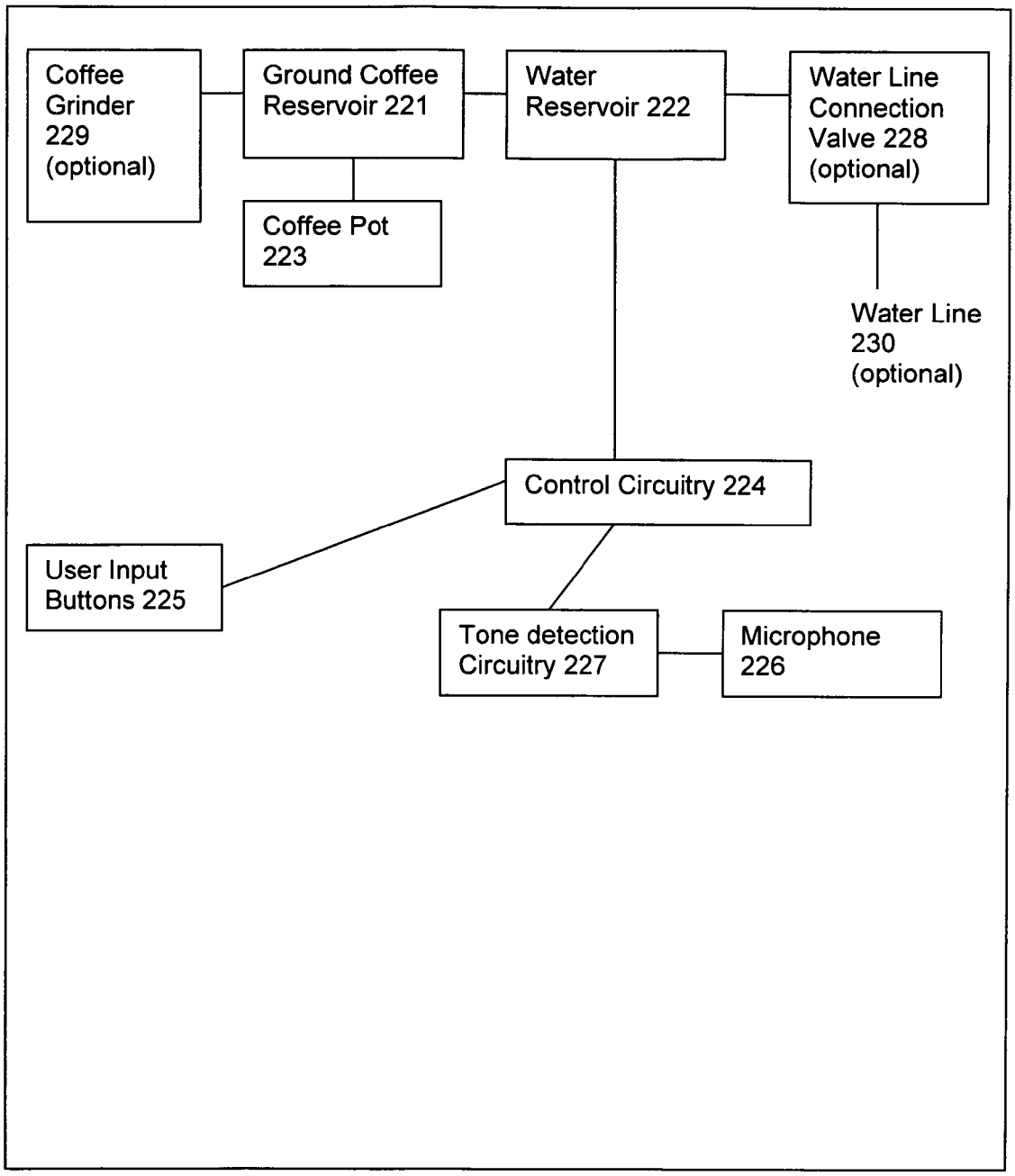
FIG. 2 contains a block diagram representing the parts of an electric coffeemaker.

As shown in FIG. 2, the automatic coffeemaker 200 includes ground coffee reservoir 221, water reservoir 222, coffee pot 223, control circuitry 224, user input buttons 225, microphone 226 and tone detection circuitry 227. Optionally, if the coffeemaker is connected to a plumbed water line 230, there is water line connection valve 228, and if it can grind beans, there is a grinder unit 229 which is either physically inside the coffee reservoir 221, or adjacent to it with a mechanism for dumping the ground beans into coffee reservoir 221. The grinding of beans, heating of water, and dripping of coffee into a coffee pot are all well known in the art.

On the coffeemaker 200, a standard microphone 226, is preferably hidden inside the appliance as is standard practice in a telephone or tape recorder, and can receive the ultrasonic or audible tone. This tone can be detected using standard tone detection circuitry 227 that filters out a particular frequency tone among other sounds received by the microphone. Once the signal is received and detected, the brew cycle in the coffeemaker starts. Optionally a delay time can be preprogrammed into the coffeemaker such that it starts only after a delay time in response to such a signal being received. It is envisioned that the coffeemaker would have several ways of starting: brewing could be started manually, or based on receipt of a signal from the clock radio, or delayed brewing could occur a preprogrammed time after receipt of this signal from the clock radio.

In typical operation, the ultrasonic or audible tone signal is received in microphone 226 and detected in tone detection circuitry 227. Tone detection circuitry 227 notifies control circuitry 224 of the event, and it starts the brew cycle by turning on the heating element contained in water reservoir 222. Water reservoir 222 is previously filled by the user with water, or if the unit is plumbed to the water line 230 then water line connection valve 228 allows the appropriate amount of water into water reservoir 222. The heated water from water reservoir 222 drips through the ground coffee in ground coffee reservoir 221 and into coffee pot 223. The ground coffee in ground coffee reservoir 221 is either previously placed there by the user, or the user optionally places coffee beans in coffee grinder 229 and these beans are ground with the resulting ground coffee found in ground coffee reservoir 221. The heating element in water reservoir 222 is turned off by the control circuitry 224 after a predetermined amount of time, or based on other temperature sensing inputs, as is common in automatic coffeemakers. All of these heating, dripping, optional grinding, and other water flow and thermal/mechanical brewing steps are all well known in the art. Optionally, if the user has preprogrammed a time delay, the control circuitry 224 will wait this time between being notified of the tone detection by tone detection circuitry 227, and starting the heating process in water reservoir 222 and any optional grinding step.

Both the alarm clock radio 100 and coffeemaker 200 can be powered by any means, but it is expected they are powered by standard AC power connections. These power cords and internal power supply circuitry are not shown in the figures because it is assumed that the art of connecting AC power and converting it to a suitable form for use by the rest of the circuitry in the devices is well known. These components are similar to those typically found in commercially available clock radios and coffeemakers, respectively.

Figure 3:
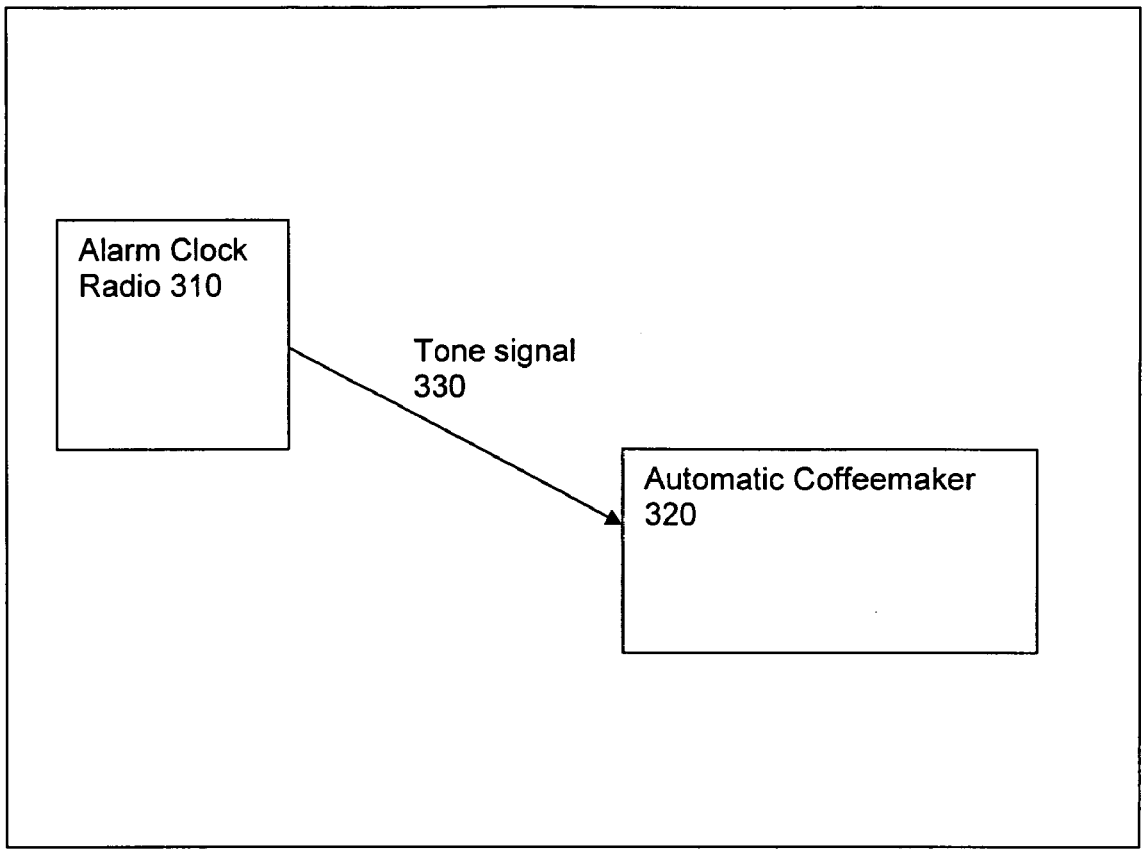
FIG. 3 contains a drawing of the entire brewing system.

FIG. 3 shows the entire brewing system 300, with the alarm clock radio 310 in one room, the coffeemaker 320 in another room, and the tone signal 330 being sent from the alarm clock radio 310 to the coffeemaker 320. The location of alarm clock radio 310 and coffeemaker 320 in the same or different rooms, on the same or different floors, or in any other location, is not critical to the invention, as long as a path for the audio signals is maintained. When the system is first installed, both alarm clock radio 310 and coffeemaker 320 are plugged in. The user can set the alarm clock radio to go off and trigger the coffeemaker, or can use the optional manual start brew function if the alarm clock radio 310 is so equipped, to test the system. If the coffeemaker starts, the test is complete. If it fails to start, the user can raise the volume level with optional volume controls on the alarm clock radio 310, and try the test again.

Figure 4:
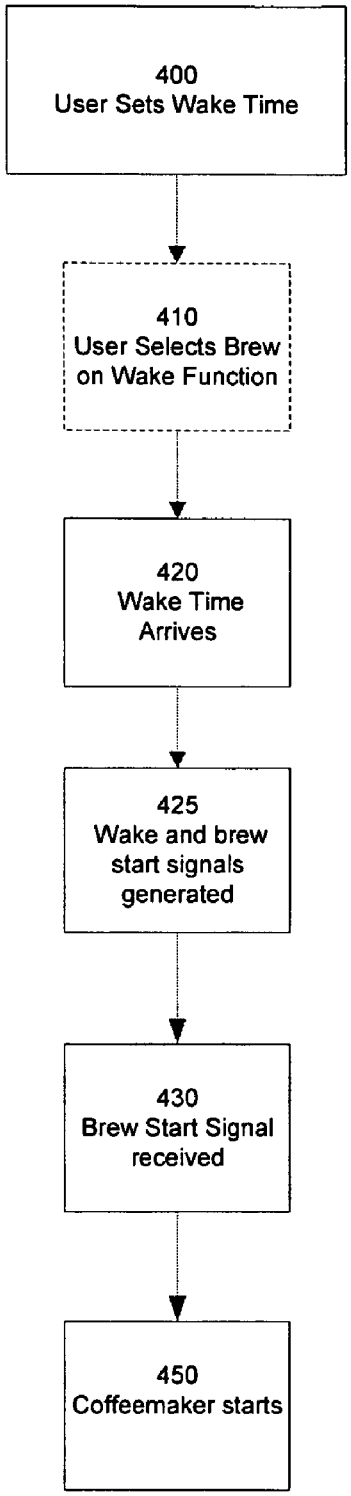
FIG. 4 provides a process flowchart for the simple brew starting process.

FIG. 4 contains the steps followed in the simple brew starting process. In step 400, the user sets the wake time, using well known techniques for setting digital alarm clocks. Typically a series of button presses is required to select the wake time on the display, and to select the wake audio, either tones, radio signals, or a combination of both. Other variations as found in typical clock radios include waking to CD, cassette tape, Apple Ipod MP3 player, or other audio sources. In step 410, the user optionally selects the brew on wake function in the alarm clock and on the coffeepot. This would typically require an additional button press beyond what would be required to select the normal wake time and audio source in the clock radio. This step is optional, because in one embodiment of the invention, the user does not have to select brew on wake; the brew on wake function occurs automatically in the clock radio, the brew on wake signal is automatically sent, and whether or not the coffee eventually brews depends on the capabilities and settings of the coffeemaker. In the clock radio, typically icons or other visual indicators show that the alarm has been set. An icon of a coffee pot, or a simple red dot (as displayed by an LED) could be illuminated next to the word "Coffee" to show the successful selection of this option. At the same time, or earlier, or later, the user optionally presses a button on the coffeemaker to set it to respond to the brew on wake signal. This is optional because in one embodiment of the invention, the coffeemaker automatically responds to the brew on wake signal, without the need for it to be preset by the user. While in all of the time or function setting steps it is assumed that button presses are used, clearly dials or other input means can be used as known in the art.

Some time elapses and in step 420, the wake time arrives. Immediately after, in step 425, the wake signals and brew start signals are generated. The wake signals are those previously set by the user in step 400. The brew start signal is the ultrasonic or audible tone the coffeemaker is designed to detect. In step 430, the coffeemaker receives and detects the brew start signal. In step 450, the coffeemaker starts its brew process.

Figure 5:
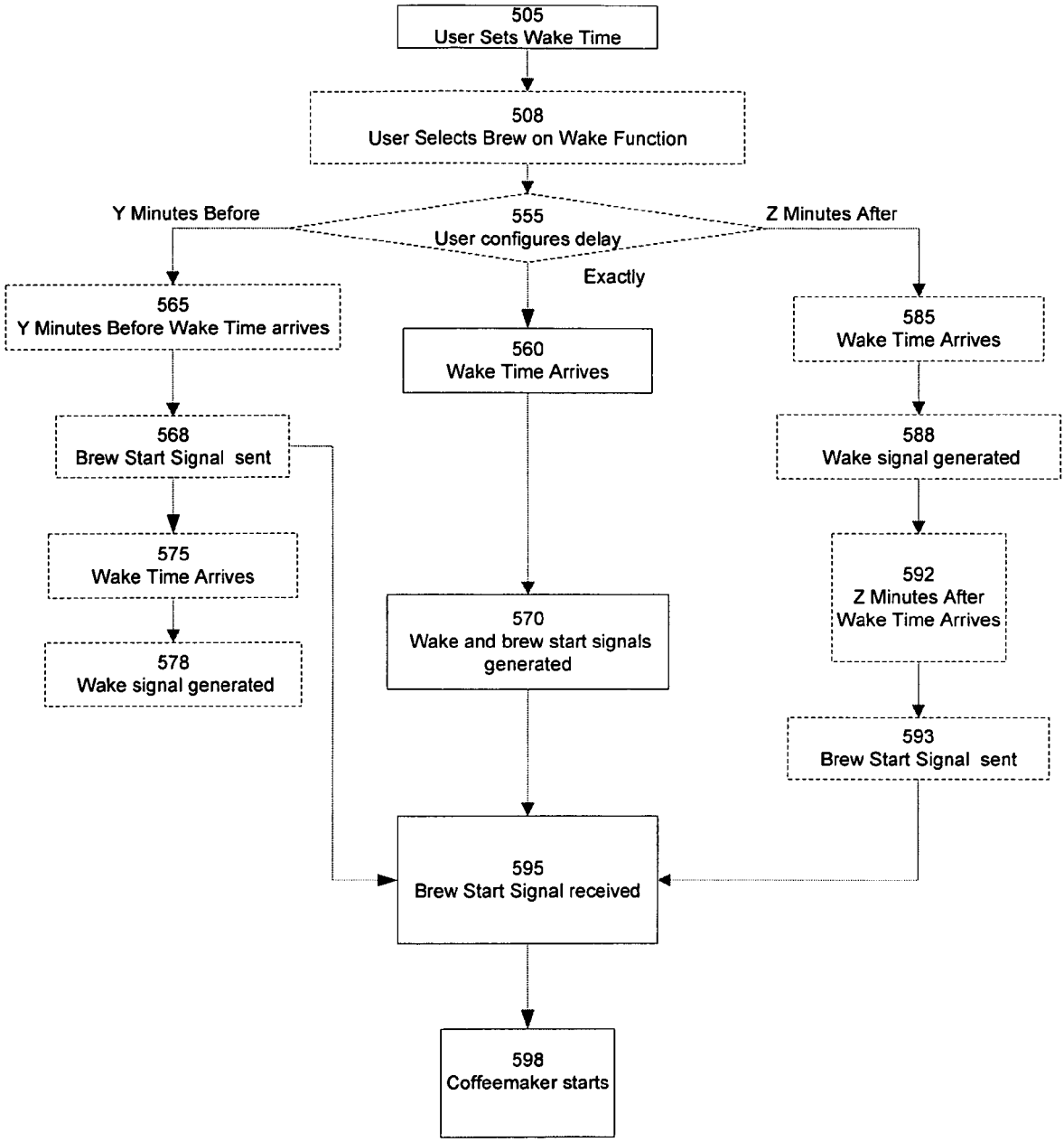
FIG. 5 provides a process flowchart for the brew starting process with variable delay options in the alarm clock.

FIG. 5 contains the steps followed in the brew starting process with variable delay options in the alarm clock radio. In step 505, the user sets the wake time, using well known techniques for setting digital alarm clocks. Typically a series of button presses is required to select the wake time on the display, and to select the wake audio, either tones, radio signals, or a combination of both. Other variations as found in typical clock radios include waking to CD, cassette tape, Apple Ipod MP3 player, or other audio sources. In step 508, the user optionally selects the brew on wake function in the alarm clock and the coffeepot. This typically requires an additional button press beyond what would be required to select the normal wake time and audio source in the clock radio. This step is optional, because in one embodiment of the invention, the user does not have to select brew on wake; the brew on wake function occurs automatically in the clock radio, the brew on wake signal is automatically sent, and whether or not the coffee eventually brews depends on the capabilities and settings of the coffeemaker. In the clock radio, typically icons or other visual indicators show that the alarm has been set. An icon of a coffee pot, or a simple red dot (as displayed by an LED) could be illuminated next to the word "Coffee" to show the successful selection of this option. At the same time, or earlier, or later, the user optionally presses a button on the coffeemaker to set it to respond to the brew on wake signal. This is optional because in one embodiment of the invention, the coffeemaker automatically responds to the brew on wake signal, without the need for it to be preset by the user.

This is followed by another optional step 555, where the user can configure a delay start function in the alarm clock radio. The user can select from one of three options in this step. The user can select brewing to start Y minutes before the wake time, exactly at the wake time, or Z minutes after the wake time. The user selects these options and times using the same methods used in step 505 and 508 to set the wake time and brew function respectively. These include a series of button presses, and indicators shown in the display. In this programming step, the user chooses a number of minutes, referred to as Y or Z minutes. This setting of a time and function on an alarm clock radio is well known in the art. If the user selects Y minutes in optional step 555, then the optional steps 565, 568, 575, and 578 follow in sequence. In step 565, some time after the user has set the alarm clock, the time of "Y minutes before the wake time" arrives. In step 568, the brew start signal is sent The brew start signal is the ultrasonic or audible tone the coffeemaker is designed to detect. In step 595, the coffeemaker receives and detects the brew start signal. In step 598, the coffeemaker starts its brew process. Returning back to step 568, after some time elapses, the wake time arrives in 575. Next, in step 578, the wake signals are generated. The wake signals are those previously set by the user in step 505.

If in step 555, the user selects the exactly at the wake time option, or if step 555 is not included, because its presence is optional, then the operation proceeds to step 560. In step 560 the wake time arrives. Step 570 follows and the wake and brew start signals are generated in parallel. These wake signals are previously set by the user in step 505. The brew start signal is the ultrasonic, audible tone or other signal that the coffeemaker is designed to detect. In step 595, the coffeemaker receives and detects the brew start signal. In step 598, the coffeemaker starts its brew process.

If in step 555 the user selects the optional Z minutes after option, then optional steps 585, 588, 592, and 593 follow in sequence. In step 585, the wake time arrives. This is followed by step 588, where the wake signal is generated by the alarm clock radio. The wake signals are those previously set by the user in step 505. After Z minutes of time elapses after the wake time, we arrive at step 592. Then at step 593, the brew start signal is sent. The brew start signal is the ultrasonic, audible tone or other signal that the coffeemaker is designed to detect. In step 595, the coffeemaker receives and detects the brew start signal. In step 598, the coffeemaker starts its brew process.

Figure 6:
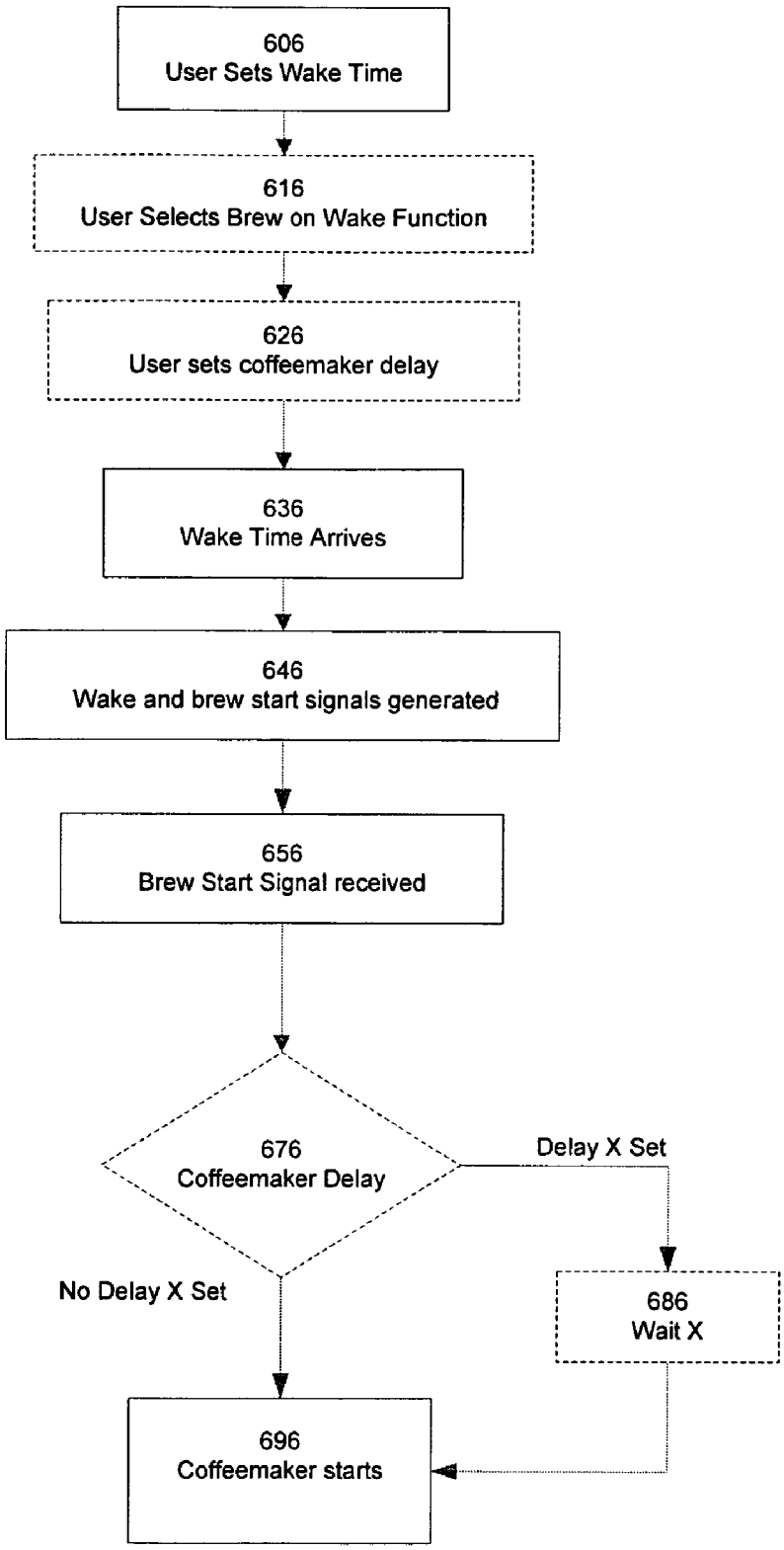
FIG. 6 provides a process flowchart for the brew starting process with a start delay option in the coffeemaker.

FIG. 6 contains the steps followed in the brew starting process with a start delay option in the coffeemaker. In step 606, the user sets the wake time, using well known techniques for setting digital alarm clocks. Typically a series of button presses is required to select the wake time on the display, and to select the wake audio, either tones, radio signals, or a combination of both. Other variations as found in typical clock radios include waking to CD, cassette tape, Apple Ipod MP3 player, or other audio sources. In step 616, the user optionally selects the brew on wake function in the alarm clock and the coffeepot. This typically requires an additional button press beyond what would be required to select the normal wake time and audio source in the clock radio. This step is optional, because in one embodiment of the invention, the user does not have to select brew on wake; the brew on wake function occurs automatically in the clock radio. Thus, the brew on wake signal is automatically sent, and whether or not the coffee eventually brews depends on the capabilities and settings of the coffeemaker. In the clock radio, typically icons or other visual indicators show that the alarm has been set. For example, an icon of a coffee pot or a simple red dot (as displayed by an LED) could be illuminated next to the word "Coffee" to show the successful selection of this option. At the same time, or earlier, or later, the user optionally presses a button on the coffeemaker to set it to respond to the brew on wake signal. This is optional because in one embodiment of the invention, the coffeemaker automatically responds to the brew on wake signal, without the need for it to be preset by the user.

In an optional step 626, the user can set a delay on the coffeemaker. This is a start delay of X minutes, where the user can select X with a series of button presses similar to those used to set time of day or start time on a coffeemaker. These time setting techniques are well known in the art.

In step 636, the wake time arrives. Immediately after, in step 646, the wake signals and brew start signals are generated. The wake signals are those previously set by the user in step 606. The brew start signal is the ultrasonic, audible tone or other signal that the coffeemaker is designed to detect. In step 656, the coffeemaker receives and detects the brew start signal.

Step 676 may then occur. Step 676 is optional because in one embodiment of the invention, the user can choose to set a start delay in the coffeemaker, but this is not necessary for the invention to function. If the user previously set a coffeemaker start delay of X minutes in step 626, then at step 686, a delay of X minutes takes place. Then the coffeemaker starts at step 696. If no delay had been set in Step 626 by the user, the process proceeds immediately from step 676 to step 696 and the coffeemaker starts without intentional delay.

While the invention as described refers to an electric drip coffeemaker, the same principles could apply to a tea maker, hot chocolate maker, espresso maker, electric percolator, or any other device creating a heated beverage, where the pushing of a brew start button on the device is instead substituted for by the generation and reception of a brew start signal from an alarm clock device as described in this invention.

Although embodiments of the invention have been discussed primarily with respect to specific embodiments thereof, other variations are possible. Steps may be performed by hardware or software, as desired. Note that steps can be added to, taken from or modified from the steps in this specification without deviating from the scope of the invention. In general, any flowcharts presented are only intended to indicate one possible sequence of basic operations to achieve a function, and many variations are possible.

While the specification has been described in detail with respect to specific embodiments of the invention, it will be appreciated that those skilled in the art, upon attaining an understanding of the foregoing, may readily conceive of alterations to, variations of, and equivalents to these embodiments. These and other modifications and variations to the present invention may be practiced by those of ordinary skill in the art, without departing from the spirit and scope of the present invention, which is more particularly set forth in the appended claims. Furthermore, those of ordinary skill in the art will appreciate that the foregoing description is by way of example only, and is not intended to limit the invention.

What is claimed is:

1. A system for coordinating alarm time and coffee brew time, comprising:

a. an alarm comprising:
  i. an alarm timer capable of being set by a user;
  ii. an alarm controller,
  iii. an alarm input means;
  iv. a speaker
  v. sound generation means capable of generating a signal tone and transmitting the signal tone with the speaker; and
  vi. an alarm display,
  vii. wherein the speaker is capable of providing a wake sound to wake the user; and b. an electric coffeemaker comprising:
  i. tone reception means capable of receiving the signal tone and forwarding the signal tone;
  ii. tone detection means capable of receiving the signal tone from the tone reception means and capable of sending related data; and
  iii. coffee brewing means capable of receiving the related data and capable of activating a brew cycle in response to the related data.

2. The system of claim 1, wherein the alarm input means is at least one of a dial and a button.

3. The system of claim 1, wherein the sound generation means comprises radio reception circuitry and tone generation circuitry.

4. The system of claim 1, wherein the tone reception means comprises a microphone and amplification means.

5. The system of claim 1, wherein the tone detection means comprises circuitry that detects a signal tone of a particular frequency.

6. The system of claim 1, wherein the coffee brewing means comprises circuitry for activating the brew function in the electric coffeemaker.

7. The system of claim 1, wherein the signal tone is an ultrasonic signal.

8. The system of claim 1, wherein the signal tone is audible.

9. The system of claim 1, wherein the alarm is an alarm clock radio device.

10. The system of claim 1, wherein the user programs the alarm to generate the wake sound at a programmed alarm time and wherein the user programs the alarm to send the signal tone at the programmed alarm time.

11. The system of claim 1, wherein the user programs the alarm to generate the wake sound at a programmed alarm time and wherein the user programs the alarm to send the signal tone before the programmed alarm time.

12. The system of claim 1, wherein the user programs the alarm to generate the wake sound at a programmed alarm time and wherein the user programs the alarm to send the signal tone after the programmed alarm time.

13. The system of claim 1, wherein the electric coffeemaker starts the brew cycle immediately upon receipt of the related data.

14. The system of claim 1, wherein the electric coffeemaker starts the brew cycle a certain amount of time after receipt of the related data signal, wherein the certain amount of time was preprogrammed into the electric coffeemaker by the user.

15. The system of claim 1, wherein the electric coffeemaker uses ground coffee.

16. The system of claim 1, wherein the electric coffeemaker uses coffee beans, and the coffee beans are ground when the brew cycle is activated.

17. The system of claim 1, wherein the electric coffeemaker further comprises a water reservoir, and wherein water is first poured into the reservoir by the user before the brew cycle is activated.

18. The system of claim 1, wherein the electric coffeemaker further comprises an inlet valve for water from a water supply line, and wherein water flows into the electric coffeemaker through the inlet valve from the water supply line.

* * * * *